US009670623B2

(12) United States Patent
Ciloglu et al.

(10) Patent No.: US 9,670,623 B2
(45) Date of Patent: Jun. 6, 2017

(54) STRAY CURRENT RESISTANT DIRECT FIXATION FASTENER

(71) Applicants: Korhan Ciloglu, Pittsburgh, PA (US); Robert Alsop, Tucker, GA (US); Pete Frye, Pittsburgh, PA (US); Michael O'Connell, Atlanta, GA (US)

(72) Inventors: Korhan Ciloglu, Pittsburgh, PA (US); Robert Alsop, Tucker, GA (US); Pete Frye, Pittsburgh, PA (US); Michael O'Connell, Atlanta, GA (US)

(73) Assignee: L B Foster Company, Pittsburgh, PA (US)

( * ) Notice: Subject to any disclaimer, the term of this patent is extended or adjusted under 35 U.S.C. 154(b) by 14 days.

(21) Appl. No.: 14/477,503

(22) Filed: Sep. 4, 2014

(65) Prior Publication Data

US 2015/0060561 A1 Mar. 5, 2015

Related U.S. Application Data

(60) Provisional application No. 61/873,824, filed on Sep. 4, 2013.

(51) Int. Cl.

| | |
|---|---|
| ***E01B 9/60*** | (2006.01) |
| ***E01B 9/62*** | (2006.01) |
| ***E01B 26/00*** | (2006.01) |
| *E01B 1/00* | (2006.01) |

(52) U.S. Cl.

CPC ..... *E01B 9/60* (2013.01); *E01B 26/00* (2013.01); *E01B 1/002* (2013.01)

(58) Field of Classification Search

CPC ..... E01B 9/00; E01B 9/02; E01B 9/04; E01B 9/22; E01B 9/28; E01B 9/38; E01B 9/40; E01B 9/44; E01B 9/62

USPC ..... 238/264, 265, 269, 283, 287, 297, 298, 238/310, 315, 382

See application file for complete search history.

(56) References Cited

U.S. PATENT DOCUMENTS

2006/0196962 A1* 9/2006 Osler ..... E01B 9/62 238/287

* cited by examiner

*Primary Examiner* — R. J. McCarry, Jr.

(74) *Attorney, Agent, or Firm* — Paul D Bangor, Jr.; Clark Hill, PLC

(57) ABSTRACT

A bonded fastener for a railway rail comprising: top and bottom generally horizontal plates bonded and separated by an insulating material wherein the top plate defines a rail bed; a plurality of clip housings wherein each clip housing houses part of a hold-down clip for attaching the rail to the bonded fastener; a plurality of anchor assembly areas wherein each anchor assembly area defines an opening through the bonded fastener for receiving an attachment device for attaching the fastener to a supporting surface; and one or more generally vertical barriers comprising part of the bonded fastener. Further, a first generally horizontal barrier may extend from the bonded fastener underneath each of the clip housings, and a second generally horizontal barrier may extend from the rail bed underneath the rail on each side of the bonded fastener.

14 Claims, 2 Drawing Sheets

STRAY CURRENT RESISTANT DIRECT FIXATION FASTENER

CROSS REFERENCE TO RELATED APPLICATIONS

This application claims the benefit of the filing date of U.S. provisional patent application Ser. No. 61/873,824, filed on Sep. 4, 2013, the entirety of which is incorporated herein by reference for all purposes.

BACKGROUND OF THE INVENTION

Direct fixation fasteners (DFFs) are commonly used in railway track construction especially in ballastless track applications. They are used to fasten railway track rails to the underlying structure. DFFs accomplish three major tasks in track design: 1. hold running rails at a certain position in track and keep gauge distance between the rails, 2. provide vibration and noise attenuation due their resilience, 3. electrical insulation. All DFF designs are inherently insulating at a very high level when they are produced and tested in lab environment. However, their insulation properties are degraded over time in track due many different factors such as presence of conductive contaminants, water and other media. Degraded insulation properties cause stray currents leaking from the running rail through the fastener down to the structure to which the fasteners are attached. Stray currents accelerate deterioration of the fasteners and cause corrosion on utility lines and rebars. The DFF of the present disclosure has added insulating elements on the body of the DFF and at the anchor locations to significantly reduce the likelihood of stray current running through the DFF.

SUMMARY OF THE INVENTION

In a preferred aspect, the present disclosure comprises a bonded fastener for a railway rail comprising: top and bottom generally horizontal plates bonded and separated by an insulating material wherein the top plate defines a rail bed; a plurality of clip housings wherein each clip housing houses part of a hold-down clip for attaching the rail to the bonded fastener; a plurality of anchor assembly areas wherein each anchor assembly area defines an opening through the bonded fastener for receiving an attachment device for attaching the fastener to a supporting surface; and one or more generally vertical barriers comprising part of the bonded fastener.

In another preferred aspect, the insulating material completely envelopes each of the top and bottom plates, the clip housings and the one or more vertical barriers.

In yet another preferred aspect, the insulating material at least partially envelopes each of the top and bottom plates, the clip housings and the one or more vertical barriers.

In a further preferred aspect, each of the one or more vertical barriers is made from or enveloped by the insulating material.

In another preferred aspect, the bonded fastener further comprises one or more generally horizontal barriers made from or enveloped by the insulating material.

In yet another preferred aspect, each of the one or more generally horizontal barriers is made from the insulating material.

In a further preferred aspect, a first generally horizontal barrier extends from the bonded fastener underneath each of the clip housings.

In another preferred aspect, a second generally horizontal barrier extends from the rail bed underneath the rail on each side of the bonded fastener.

In yet another preferred aspect, each of the first generally horizontal barriers has at least one slanted portion and at least one curved portion.

In another preferred aspect, a first generally horizontal barrier extends from the bonded fastener underneath each of the clip housings, and a second generally horizontal barrier extends from the rail bed underneath the rail on each side of the bonded fastener.

In a further preferred aspect, each of the first generally horizontal barriers has at least one slanted portion and at least one curved portion.

In another preferred aspect, the insulating material is rubber.

In a further preferred aspect, the top and bottom plates are made of cast iron.

In another preferred aspect, at least one generally vertical barrier is disposed between the rail and each anchor assembly area.

In yet another preferred aspect, two generally vertical barriers are disposed between the rail and each anchor assembly area.

In another preferred aspect, the bonded fastener further comprises electrical insulation to electrically insulate each attachment device.

DETAILED DESCRIPTION OF THE INVENTION

Figure 1:
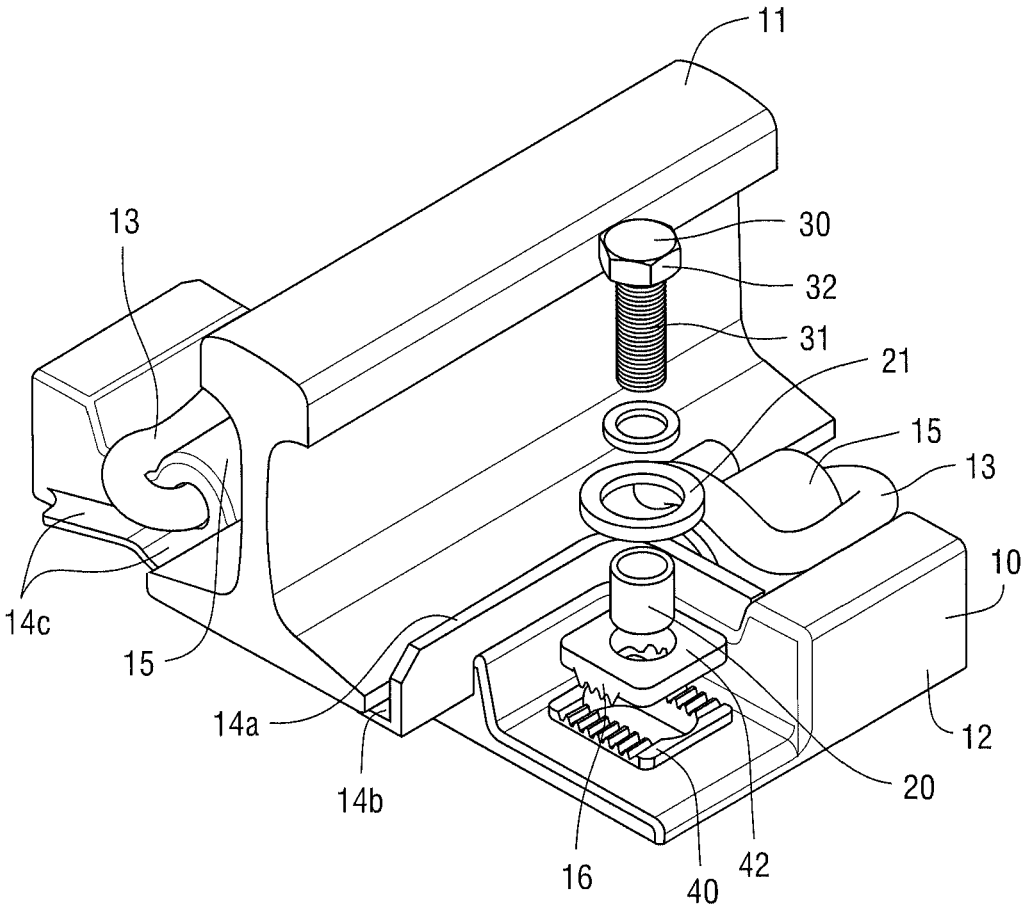
FIG. 1 is a side perspective view of a preferred bonded fastener of the present disclosure.
Figure 2:
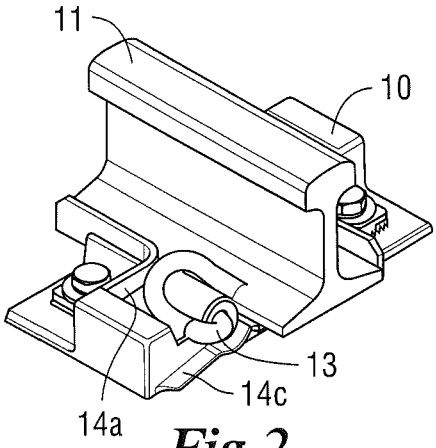
FIG. 2 is a top perspective view of a preferred bonded fastener of the present disclosure.
Figure 3:
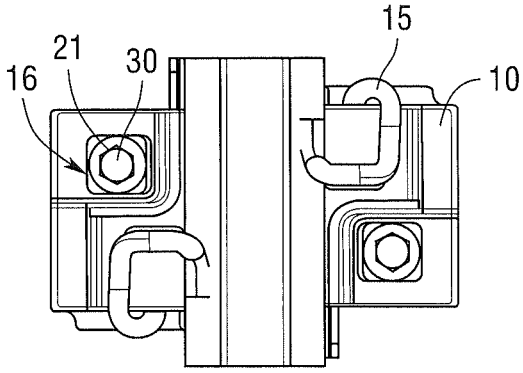
FIG. 3 is a top plan view of a preferred bonded fastener of the present disclosure.
Figure 4:
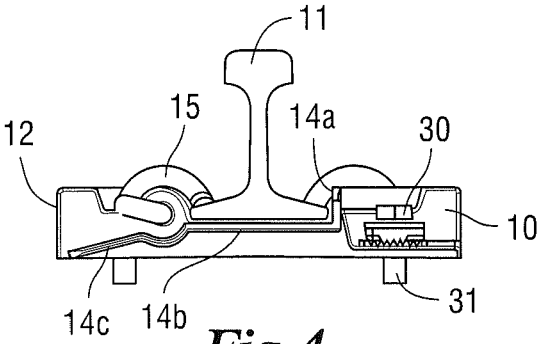
FIG. 4 is a side elevational view of a preferred bonded fastener of the present disclosure.
Figure 5:
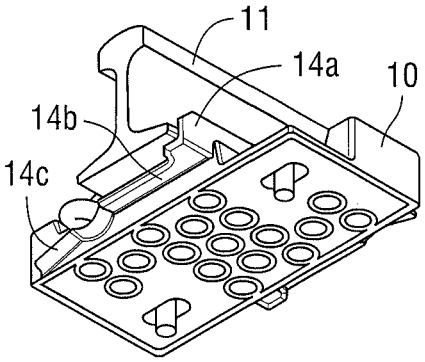
FIG. 5 is a bottom perspective view of a preferred bonded fastener of the present disclosure.
Figure 6:
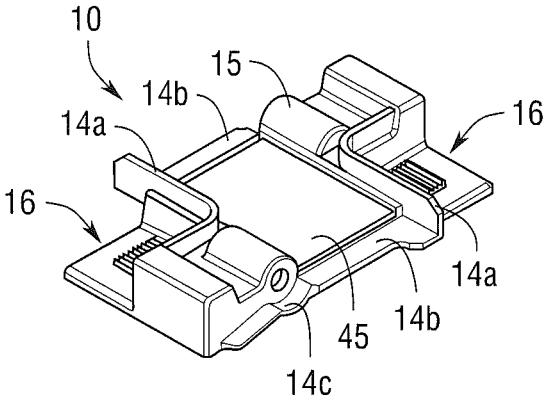
FIG. 6 is a top perspective view of a preferred bonded fastener of the present disclosure shown without a rail.

In the following detailed description, reference is made to the accompanying examples and figures that form a part hereof, and in which is shown, by way of illustration, specific embodiments in which the subject matter of the present disclosure may be practiced. These embodiments are described in sufficient detail to enable those skilled in the art to practice them, and it is to be understood that other embodiments may be utilized and that structural or logical changes may be made without departing from the scope of the subject matter of the present disclosure. Such embodiments of the subject matter of the present disclosure may be referred to, individually and/or collectively, herein by the term "disclosure" merely for convenience and without intending to voluntarily limit the scope of this application to any single disclosure or concept if more than one is in fact disclosed. The following description is, therefore, not to be taken in a limited sense, and the scope of the subject matter of the present disclosure is defined by the appended claims and their equivalents.

The Figures disclose the bonded DFF 10 of the present disclosure which comprises top and bottom cast iron or metal plates (not shown) bonded together with a vulcanized rubber component 12 including a layer (not shown) separating the plates. A rail bed 45 is defined by the top plate. This rubber component 12 provides a resilient layer for wheel impacts and vibration; it also electrically separates the running rail from the ground. The outside surface of the rubber component 12 of DFF 10 is exposed to many different contaminants in track, especially in tunnel applications. This contaminant build-up on the outside surface of the DFF 10 is damaging to its electrical insulation properties, because stray currents leak through these contaminated surfaces. Traditional DFF designs don't include any features to diminish the risk of stray current build-up during service. Stray currents are highly related to the track conditions and the surrounding environment.

In the DFF 10 of the present disclosure, additional barriers/components 14A, 14B, and/or 14C, typically of vulcanized rubber, are preferably integrally formed as part of rubber component 12 to minimize and/or prevent stray currents. This has been accomplished by two features of DFF 10, namely, (1) strategically adding the additional rubber barriers/components 14A, 14B and/or 14C as part of the outer surface of rubber component 12 and (2) electrically insulating the anchor assembly area 16 and bolt or attachment device 30 of DFF 10.

Strategically adding additional barriers/components 14A, 14 and/or 14C: this preferably is done at the time of molding of the DFF 10, hence no more steps are added to the manufacturing process, but the rubber molding design is changed as shown in the drawings. Preferably, the additional barriers/components 14A, 14B and/or 14C do not interfere with installation and/or removal of rail 11 or hold-down clip 13. Additional barriers/components 14A, 14B, and/or 14C are strategically positioned so that all electrical paths for stray currents between the rail 11 and ground are broken or impeded. Additional insulating barriers/components 14A preferably are disposed in vertical or substantially vertical planes around the anchor assembly areas 16 and anchor bolts 30. Drip edges 14B and/or 14C are added where appropriate and as shown in the drawings. Mechanical properties such as fastener stiffness preferably are not impacted by the presence of additional barriers/components 14A, 14B and/or 14C.

Insulating the anchor assembly 16; the anchor assembly 16 is not electrically insulated in the traditional design, because all electrical insulation is expected to be provided through the rubber layer. Incorporating anchor electrical insulation will be redundant and provide an additional layer of protection against stray currents. Preferably, the electrical insulation for anchor assembly 16 comprises an electrically insulating bushing/cylinder 20 that insulates the shaft 31 of bolt 30 from serrated casting plate 40 and serrated cover plate 42 of DFF 10. The electrical insulation for anchor assembly 16 also comprises an electrically insulating washer 21 for insulating the head 32 of bolt 30 from the serrated cover plate 42 of DFF 10. Preferably, the washer 21 is a separate component and not integrally formed with bushing/cylinder 20. Here the electrical insulating materials for the anchor assembly 16 and/or bolt 30 may preferably comprise G10 material, glass reinforced nylon material, rubber, or Mylar.

In the foregoing Detailed Description, various features are grouped together in a single embodiment to streamline the disclosure. This method of disclosure is not to be interpreted as reflecting an intention that the claimed embodiments of the disclosure require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

The invention claimed is:

1. A bonded fastener for a railway rail comprising:

top and bottom generally horizontal plates bonded and separated by an insulating material wherein the top plate defines a rail bed;

a plurality of clip housings wherein each clip housing houses part of a hold-down clip for attaching the rail to the bonded fastener;

a plurality of anchor assembly areas wherein each anchor assembly area defines an opening through the bonded fastener for receiving an attachment device for attaching the fastener to a supporting surface; and one or more generally vertical barriers comprising part of the bonded fastener; wherein the insulating material completely envelopes each of the top and bottom plates, the clip housings and the one or more vertical barriers.

2. The bonded fastener of claim 1 wherein each of the one or more vertical barriers is made from the insulating material.

3. The bonded fastener of claim 1 further comprising one or more generally horizontal barriers made from or enveloped by the insulating material.

4. The bonded fastener of claim 3 wherein each of the one or more generally horizontal barriers is made from the insulating material.

5. The bonded fastener of claim 3 wherein a first generally horizontal barrier extends from the bonded fastener underneath each of the clip housings.

6. The bonded fastener of claim 5 wherein a second generally horizontal barrier extends from the rail bed underneath the rail on each side of the bonded fastener.

7. The bonded fastener of claim 5 wherein each of the first generally horizontal barriers has at least one slanted portion and at least one curved portion.

8. The bonded fastener of claim 1 wherein insulating material is rubber.

9. The bonded fastener of claim 1 wherein the top and bottom plates are made of cast iron.

10. The bonded fastener of claim 1 wherein at least one generally vertical barrier is disposed between the rail and each anchor assembly area.

11. The bonded fastener of claim 1 wherein two generally vertical barriers are disposed between the rail and each anchor assembly area.

12. The bonded fastener of claim 1 further comprising electrical insulation to electrically insulate each attachment device.

13. A bonded fastener for a railway rail comprising:

top and bottom generally horizontal plates bonded and separated by an insulating material wherein the top plate defines a rail bed;

a plurality of clip housings wherein each clip housing houses part of a hold-down clip for attaching the rail to the bonded fastener;

a plurality of anchor assembly areas wherein each anchor assembly area defines an opening through the bonded fastener for receiving an attachment device for attaching the fastener to a supporting surface; and one or more generally vertical barriers comprising part of the bonded fastener; wherein the insulating material at least partially envelopes each of the top and bottom plates, the clip housings and the one or more vertical barriers; and one or more generally horizontal barriers made from or enveloped by the insulating material, wherein a first generally horizontal barrier extends from the bonded fastener underneath each of the clip housings, and wherein a second generally horizontal barrier extends from the rail bed underneath the rail on each side of the bonded fastener.

14. The bonded fastener of claim 13 wherein each of the first generally horizontal barriers has at least one slanted portion and at least one curved portion.

* * * * *